US009790820B2

(12) United States Patent
Evans

(10) Patent No.: US 9,790,820 B2
(45) Date of Patent: Oct. 17, 2017

(54) SWITCHING OIL GALLERY DE-AERATION

(71) Applicant: Schaeffler Technologies AG & Co. KG, Herzogenaurach (DE)

(72) Inventor: Matthew Evans, Warren, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 109 days.

(21) Appl. No.: 14/858,221

(22) Filed: Sep. 18, 2015

(65) Prior Publication Data

US 2016/0102585 A1 Apr. 14, 2016

Related U.S. Application Data

(60) Provisional application No. 62/062,448, filed on Oct. 10, 2014.

(51) Int. Cl.
*F01L 1/245* (2006.01)
*F01L 1/14* (2006.01)

(52) U.S. Cl.
CPC ..... *F01L 1/245* (2013.01); *F01L 1/146* (2013.01)

(58) Field of Classification Search
CPC ..... F01L 1/22; F01L 1/24; F01L 1/245; F01L 1/14; F01L 1/146
USPC ..... 123/90.12
See application file for complete search history.

(56) References Cited

U.S. PATENT DOCUMENTS

| | | | | |
|---|---|---|---|---|
| 4,657,043 | A * | 4/1987 | Ampferer | F01M 1/16 137/538 |
| 6,321,704 | B1 * | 11/2001 | Church | F01L 1/146 123/198 F |
| 6,557,518 | B1 * | 5/2003 | Albertson | F01L 13/0005 123/198 F |
| 6,584,942 | B1 * | 7/2003 | Albertson | F01L 1/14 123/90.12 |
| 6,802,288 | B2 | 10/2004 | Spath | |
| 7,909,007 | B2 | 3/2011 | Manther et al. | |
| 8,235,017 | B2 | 8/2012 | Schafer et al. | |
| 2008/0035085 | A1 * | 2/2008 | Hendriksma | F01L 13/0005 123/90.16 |

* cited by examiner

*Primary Examiner* — Phutthiwat Wongwian
*Assistant Examiner* — Loren Edwards
(74) *Attorney, Agent, or Firm* — Volpe and Koenig, P.C.

(57) ABSTRACT

A switching oil gallery de-aeration arrangement for a switchable valve arrangement is provided, including a switching control valve that activates or deactivates the switchable valve arrangement. The switching control valve is movable from a first position, in which pressurized hydraulic fluid from a hydraulic lash adjuster fluid gallery flows to a passage on the hydraulic lash adjuster and through a switching hydraulic fluid gallery to a check valve such that pressurized hydraulic fluid from the hydraulic lash adjuster fluid gallery pressurizes the switching hydraulic fluid gallery and is released through the check valve, and a second position, in which pressurized hydraulic fluid having a higher pressure sufficient for carrying out a switching function of the switchable valve arrangement is delivered by the switching hydraulic fluid gallery via the second intersection to the second port.

10 Claims, 3 Drawing Sheets

SWITCHING OIL GALLERY DE-AERATION

INCORPORATION BY REFERENCE

The following documents are incorporated herein by reference as if fully set forth: U.S. Provisional Patent Application No. 62/062,448, filed Oct. 10, 2014.

FIELD OF INVENTION

The present invention relates to a switching oil gallery used in connection with switchable finger followers or switchable hydraulic lash adjusters.

BACKGROUND

Internal combustion engines include cylinder heads in which hydraulic lash adjusters are typically arranged which have hydraulic fluid galleries that feed pressurized hydraulic fluid, typically at a pressure of at least 0.5 bar, to a port defined in a housing of the hydraulic lash adjuster. A plunger is arranged within a bore of the housing and supports an end of a finger follower on a support head thereof. The plunger is axially displaceable to perform the hydraulic lash adjustment. For engines with cylinder deactivation technology, optionally a switching function can be performed by the hydraulic lash adjuster to provide a zero lift opening of the associated valve. When the switching function is provided, the hydraulic lash adjuster is provided as two parts in the form of an inner and outer housing, which are locked together for normal operation, and when deactivation is desired, a switching port of the housing feeds hydraulic fluid from a switching oil gallery, typically at a pressure of at least 1 bar, into a chamber of a locking pin to unlock the inner housing from the outer housing so that the inner housing can reciprocate within the outer housing. This is shown for example in U.S. Pat. No. 8,235,017.

It is also known to use switchable finger followers that have a first, hi-lift and a second, no or low-lift switching mode. Here, the switchable finger followers are activated or deactivated by pressurized hydraulic fluid that is fed via a feed path from the switching oil gallery, through the hydraulic lash adjuster, and to an actuator chamber in the switchable finger follower to actuate a switching function of the finger lever assembly between the first and second valve lift modes. See for example, U.S. Pat. No. 7,909,007.

One known issue with switching oil galleries is that there can be a lag time for actuation of the switching function, whether in the hydraulic lash adjuster or in a switchable finger follower, due to air bubbles in the hydraulic fluid in the switching oil gallery or the switching oil hydraulic fluid path to the actuator, which at a minimum delays the switching time, affecting engine performance.

SUMMARY

Briefly stated, a switching oil gallery de-aeration arrangement for a switchable valve arrangement is provided, comprising a cylinder head including a bore, a hydraulic lash adjuster fluid gallery that intersects the bore at a first intersection, and a switching hydraulic fluid gallery that intersects the bore at a second intersection offset from the first intersection. A hydraulic lash adjuster assembly is provided comprising a housing positioned in the bore of the cylinder head including a first, hydraulic lash adjuster fluid port on a radially outer wall of the housing at the first intersection, a second switching hydraulic fluid port on the radially outer wall of the housing at the second intersection, and a passage formed on the radially outer wall between the first fluid port and the second fluid port. A plunger is arranged within the housing that is axially displaceable therein. A switching control valve is connected to a pressurized fluid source, the switching control valve being adapted to activate or deactivate the switchable valve arrangement. The switching control valve is movable from a first position, in which pressurized hydraulic fluid from the hydraulic lash adjuster fluid gallery flows to the first intersection, through the passage and through the switching hydraulic fluid gallery to a check valve such that pressurized hydraulic fluid from the hydraulic lash adjuster fluid gallery pressurizes the switching hydraulic fluid gallery and is released through the check valve, and a second position, in which pressurized hydraulic fluid having a higher pressure sufficient for carrying out a switching function of the switchable valve arrangement is delivered by the switching hydraulic fluid gallery via the second intersection to the second port.

In another aspect, the passage is formed by a flat on the radially outer wall of the housing.

In one preferred arrangement, the first and second ports are located in separate annular grooves on the radially outer wall of the housing.

In another preferred arrangement, a throttle to reduce pressure is located in the passage between the hydraulic lash adjuster fluid gallery and the switching hydraulic fluid gallery. The throttle is preferably provided in the form of a land located on the radially outer wall of the housing adjacent to the second port.

In one arrangement, the hydraulic lash adjuster assembly is switchable between two lift modes. Alternatively, a switchable roller finger follower with a hydraulically actuated locking mechanism that is switchable between two lift modes is provided that is fed pressurized hydraulic fluid from the switching oil gallery via the hydraulic lash adjuster.

Preferably, in the first position of the switching control valve, the check valve is located between the switching hydraulic fluid gallery and a tank connection. In a preferred arrangement, the check valve is set to release at a pressure of about 0.1 bar or greater.

Preferably, the hydraulic lash adjuster fluid gallery is also connected to standard hydraulic lash adjusters.

A method of de-aerating a switching hydraulic fluid gallery for a switchable valve arrangement of an internal combustion engine is also provided. The method includes providing a switching oil gallery de-aeration arrangement in accordance with one or more of the embodiments discussed above, and feeding pressurized hydraulic fluid from the hydraulic lash adjuster fluid gallery to the first intersection, through the passage and through the switching hydraulic fluid gallery to a check valve so that pressurized hydraulic fluid from the hydraulic lash adjuster fluid gallery pressurizes the switching hydraulic fluid gallery in the first position so that air bubbles in the hydraulic fluid in the switching hydraulic fluid gallery are carried to a tank connection prior to the switching control valve being moved to the second position.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
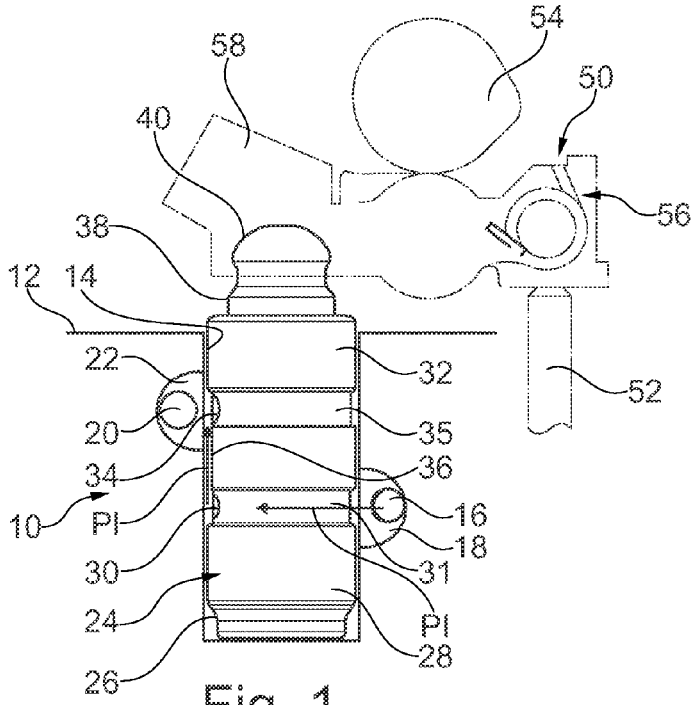
FIG. 1 is cross-sectional view through a cylinder head showing a switching oil gallery de-aeration arrangement for a switching valve arrangement used with a switchable roller finger follower.

Certain terminology is used in the following description for convenience only and is not limiting. The words "front," "rear," "upper," and "lower" designate directions in the drawings to which reference is made. The words "inwardly" and "outwardly" refer to directions toward and away from the parts referenced in the drawings. "Axially" refers to a direction along the axis of a shaft or rotating part. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 5:
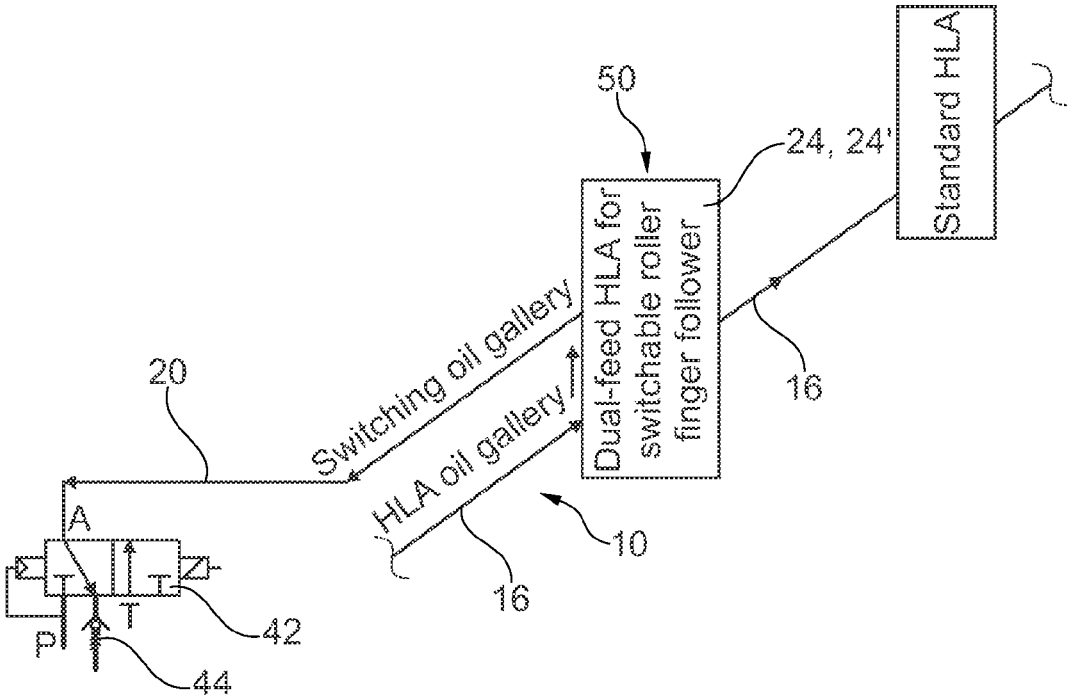
FIG. 5 is a schematic view showing the switching oil gallery de-aeration arrangement in a first position of the switching control valve.
Figure 6:
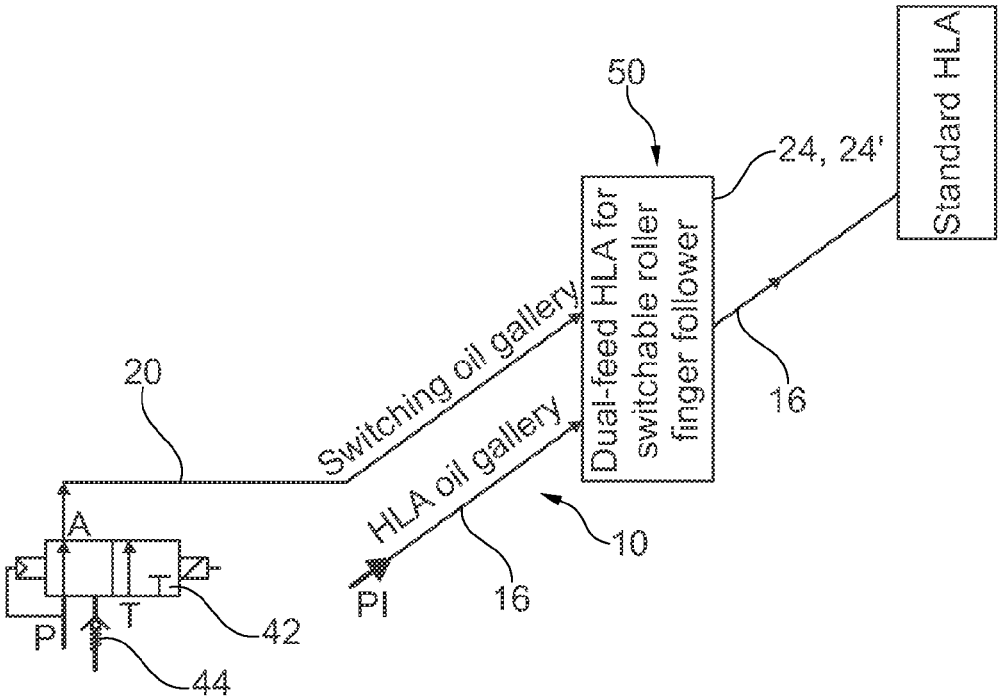
FIG. 6 is a schematic view showing the switching oil gallery de-aeration arrangement in a second position of the control valve for carrying out a switching function of the switchable valve arrangement.

Referring to FIG. 1, a switching oil gallery de-aeration arrangement 10 for use in connection with a switchable valve arrangement 50 is shown. The switching oil gallery de-aeration arrangement 10 includes a cylinder head 12 having a bore 14 that is adapted to receive a hydraulic lash adjuster assembly 24. The hydraulic lash adjuster fluid gallery 16, shown in FIGS. 1, 5, and 6, is also provided in the cylinder head 12 and intersects the bore 14 at a first intersection 18. A switching hydraulic fluid gallery 20 that also intersects the bore 14 at a second intersection 22, preferably offset axially from the first intersection 18, is also provided in the cylinder head 12. The cylinder head 12 is preferably made of cast or machined iron or aluminum, and the hydraulic lash adjuster fluid gallery 16 and the switching hydraulic fluid gallery 20 may be formed by boring through solid material to intersect the bores 14 for a number of hydraulic lash adjuster assemblies 24 that provide a dual feed for a switching function, or the galleries 16, 20 can be formed in the head using casting cores that are pre-formed to define the galleries 16, 20.

Figure 2:
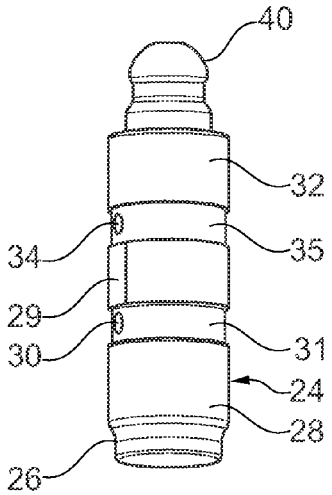
FIG. 2 is a perspective view of a hydraulic lash adjuster assembly used in connection with the switching oil gallery de-aeration arrangement shown in FIG. 1.

Referring to FIGS. 1 and 2, the hydraulic lash adjuster 24 is in the form of a dual feed hydraulic lash adjuster and includes a housing 26 that is positioned in the bore 14 of the cylinder head 12. The housing 26 preferably includes an annular body 28 and has a first, hydraulic lash adjuster fluid port 30 on a radially outer wall 32 of the housing located in a position of the first intersection 18. The first port 30 is preferably located in an annular groove 31 on the radially outer wall 32 of the housing 26. A second, switching hydraulic fluid port 34 is also located on the radially outer wall 32 of the housing 26 at the second intersection 22. Preferably, the second port 34 is also located in an annular groove 35 on the radially outer wall 32 of the housing 26. A passage 36 is formed on the radially outer wall 32 between the first fluid port 30 and the second fluid port 34. The passage 36 is preferably formed by a flat 29 on the radial outer wall 32 of the housing 26, as shown in detail in FIG. 2. The housing 26 is preferably formed as a deep drawn steel part which can be further machined, then hardened and ground to the final configuration. Alternatively, it can be a machined part. A plunger 38 with a support head 40 is arranged within the housing 26 and is axially displaceable therein. The plunger 38 provides a hydraulic lash adjustment function via pressurized oil P1, represented by an arrow in FIG. 1, flowing through the hydraulic lash adjustment fluid gallery 16 through the first port 30. The switching hydraulic fluid gallery 20 feeds pressurized hydraulic fluid for switching a switchable valve arrangement 50 through the second fluid port 34 and through an opening on the support head 40 into the switchable roller finger follower 56 (shown in broken lines in FIG. 1) when activated.

Figure 3:
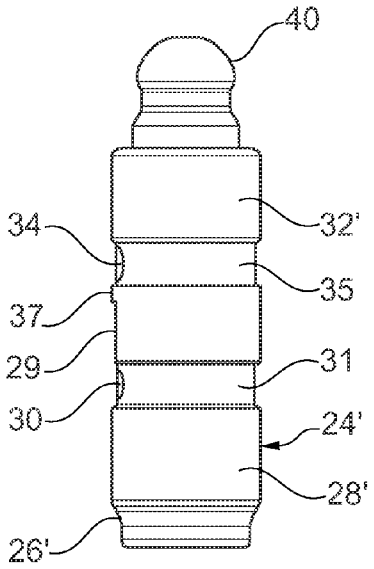
FIG. 3 is an elevational view of a second embodiment of a hydraulic lash adjuster assembly according to the invention.
Figure 4:
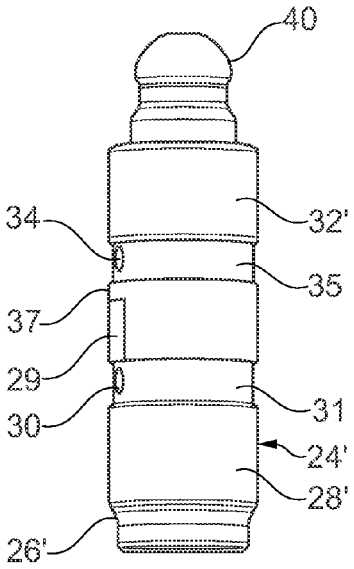
FIG. 4 is perspective view of the second embodiment of the hydraulic lash adjuster assembly shown in FIG. 3.

Referring to FIGS. 3 and 4, a second embodiment of the hydraulic lash adjuster assembly 24' is shown. The second embodiment of the hydraulic lash adjuster assembly 24' is similar to the hydraulic lash adjuster assembly 24 with the exception that a throttle 37 is located on the outer wall 32' of the housing 26' along the path of the passage 36 (shown in FIG. 1). The throttle 37 is preferably in the form of a land located on the radially outer wall 32' of the housing 26' adjacent to the second port 34. If necessary, the throttle 37 ensures that the pressure of the hydraulic fluid P1 flowing through the hydraulic lash adjuster fluid gallery 16 to the second port 34 as well as the switching hydraulic fluid gallery 20 at the second intersection 22 is not at a sufficiently high pressure to actuate the switching function. The housing 26' is also preferably formed as an annular body 28' for the second embodiment of the hydraulic lash adjuster assembly 24' and is formed in the same manner as the housing 26 discussed above.

Referring to FIGS. 5 and 6, a switching control valve 42 is connected to a pressurized fluid source P and is adapted to activate or de-activate the switchable valve arrangement 50, shown in FIG. 1. The switchable control valve 42 is movable from a first position, shown in FIG. 5, in which the pressurized hydraulic fluid P1 from the hydraulic lash adjuster fluid gallery 16 flows to the first intersection 18, through the passage 36, and through the switching hydraulic fluid gallery 20 to a check valve 44 such that pressurized hydraulic fluid P1 from the hydraulic lash adjuster fluid gallery 16 pressurizes the switching hydraulic fluid gallery 20 and is released through the check valve 44 if an over-pressure that could possible actuate the switching function occurs. The switching control valve 42 is switchable to a second position, shown in FIG. 6, in which the pressurized hydraulic fluid P which has a higher pressure sufficient to carry out a switching function of the switchable valve arrangement 50 is delivered by the switching hydraulic fluid gallery 20 via the second intersection 22 to the port 34 in order to switch to a second lift mode of the switchable valve arrangement 50.

As shown in FIGS. 5 and 6, the hydraulic lash adjuster fluid gallery is also connected to standard hydraulic lash adjusters in order to provide lash adjustment and lubrication.

The switchable valve arrangement 50 shown in FIGS. 1, 5 and 6 includes switchable roller finger followers 56 with hydraulically actuated locking mechanisms 58 that are switchable between two lift modes as discussed above in connection with U.S. Pat. No. 7,909,007, which is incorporated herein by reference as if fully set forth. This transfers the cam lift from the cam 54 to the stem 52 of a gas exchange valve in a lift mode, and can be switched to a no lift mode when activated.

In the first position of the switching control valve 42, as shown in FIG. 5, the check valve 44 is located between the switching hydraulic fluid gallery 20 and a tank connection T. Preferably, the check valve 44 is between the control valve 42 and tank T. More preferably, the check valve 44 is set to release at a pressure of about 0.1 bar or greater. This ensures that the switchable valve arrangement 50 is not inadvertently activated during de-aeration of the switching oil gallery 20 via the hydraulic fluid from the hydraulic lash adjustment oil gallery 16 being provided at too high of a pressure. In this first position of the switching control valve 42, the lower pressure oil from the hydraulic lash adjustment fluid gallery 16 clears any air bubbles from the switching hydraulic fluid gallery 20 during the entire time the engine is operating with the switching control valve 42 in the first position. This ensures that there is a solid column of hydraulic fluid in the switching hydraulic fluid oil gallery so that upon activation of the switching control valve 42 to the second position, the switching reaction time is nearly instantaneous due to the switching hydraulic fluid gallery 20 not including trapped air bubbles, which would reduce the switching reaction time.

Figure 7:
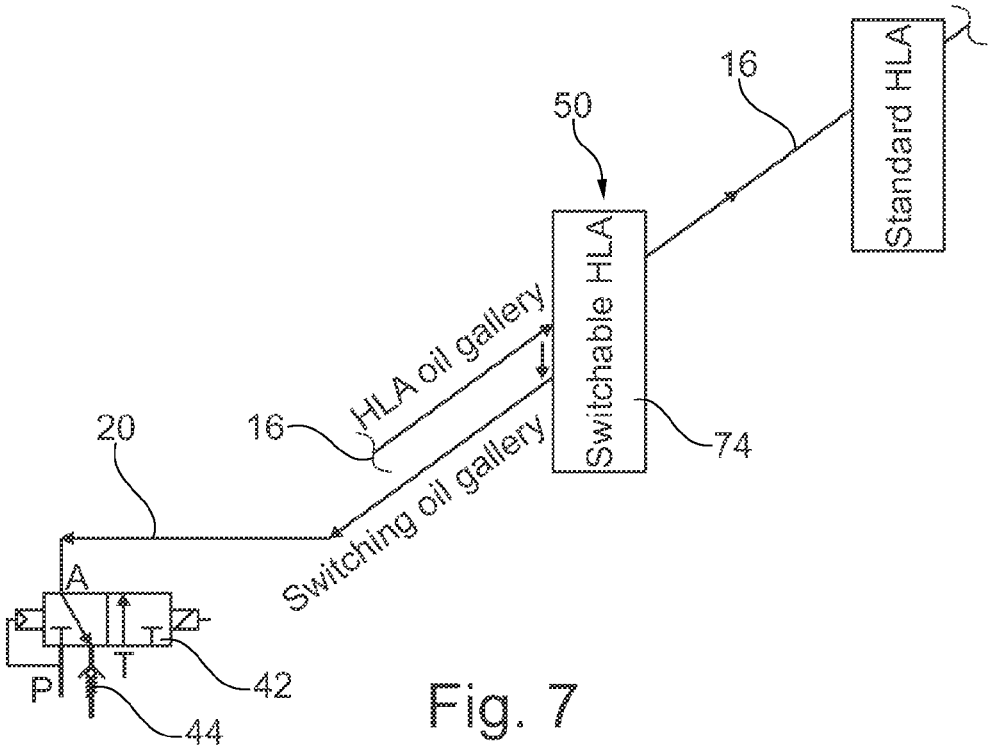
FIG. 7 is a schematic view similar to FIG. 5 showing the switching oil gallery de-aeration arrangement in the first position of the switching control valve for a valve arrangement with a switchable hydraulic lash adjuster.
Figure 8:
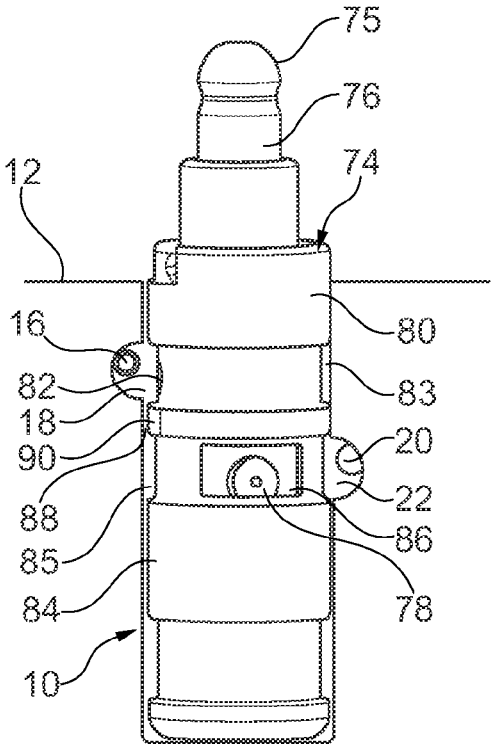
FIG. 8 is an elevational view through a cylinder head showing a switching oil gallery de-aeration arrangement for a switchable hydraulic lash adjuster.

The de-aeration arrangement 10, shown in FIG. 1, can also be used in connection with a switchable valve arrangement 50 that includes switchable hydraulic lash adjuster assemblies 74 (See FIG. 8) that are switchable between two lift modes, as discussed above in connection with U.S. Pat. No. 8,235,017. Referring to FIGS. 7 and 8, the switchable hydraulic lash adjuster 74 includes the plunger 75 that is contained within an inner housing 76 for hydraulic lash adjustment. The inner housing 76 can either be locked together with an outer housing 80 via a locking pin 78, or that can be unlocked for a zero lift mode by application of pressurized hydraulic fluid from the switching oil gallery 20, as discussed in U.S. Pat. No. 8,235,017, which is incorporated herein by reference as if fully set forth. The outer housing 80 is similar to the housing 26 discussed above, and includes a first, hydraulic lash adjuster fluid port 82 on a radially outer wall 84 of the outer housing 80 that is located at the first intersection 18, and a second, switching hydraulic fluid port 86 on the radially outer wall of the adjuster housing 80, that is located at the second intersection 22. The first port 82 is preferably located in an annular groove 83 on the radially outer wall 84 of the outer housing 80. Preferably, the second port 86 is also located in an annular groove 85 on the radially outer wall 84 of the outer housing 80. A passage 88 is formed on the radially outer wall of the outer housing 80 between the first fluid port 82 and the second fluid port 86. The passage 88 is preferably formed by a flat 90 on the radial outer wall 84 of the outer housing 80. Pressurized oil P (see FIG. 7) flowing through the second port 86 is used to actuate the switching function in order to unlock the inner housing 76 from the outer housing 80 so that the inner housing 76 can reciprocate within the outer housing 80 in order to absorb the lost motion for de-activation of a valve.

For de-aeration, in the first position of the switching control valve 42, as shown in FIG. 7, the check valve 44 is located between the switching hydraulic fluid gallery 20 and a tank connection T. Preferably, the check valve 44 is between the control valve 42 and tank T. More preferably, the check valve 44 is set to release at a pressure of about 0.1 bar or greater. This ensures that the switchable valve arrangement 50 is not inadvertently activated during de-aeration of the switching oil gallery 20 via the hydraulic fluid from the hydraulic lash adjustment oil gallery 16 being provided at too high of a pressure. In this first position of the switching control valve 42, the lower pressure oil from the hydraulic lash adjustment fluid gallery 16 clears any air bubbles from the switching hydraulic fluid gallery 20 during the entire time the engine is operating with the switching control valve 42 in the first position. This ensures that there is a solid column of hydraulic fluid in the switching hydraulic fluid oil gallery so that upon activation of the switching control valve 42 to the second position, the switching reaction time is nearly instantaneous due to the switching hydraulic fluid gallery 20 not including trapped air bubbles, which would reduce the switching reaction time.

For de-activation of a gas exchange valve, in a similar manner shown in FIG. 6, the control valve 42 would be switched to deliver pressurized hydraulic fluid to the switching oil gallery 20 so that the switchable hydraulic lash adjuster 74 is deactivated. The de-aeration arrangement 10 is therefore usable with either a dual feed hydraulic lash adjuster 24, 24' used with a switchable finger follower 56, or a switchable hydraulic lash adjuster 74.

A method of de-aerating a switchable hydraulic fluid gallery 20 for a switchable valve arrangement 50 of an internal combustion engine is also provided. The method includes providing a switching oil gallery de-aeration arrangement 10 as described above and feeding pressurized hydraulic fluid from the hydraulic lash adjuster fluid gallery 16 to the first intersection 18, through the passage 36, and through the switching oil gallery 20 to the check valve 44 so that pressurized hydraulic fluid from the hydraulic lash adjuster fluid gallery 16 pressurizes the switching hydraulic fluid gallery 20 in the first position and air bubbles in the hydraulic fluid in the switching hydraulic fluid gallery 20 that would otherwise be trapped are carried to a tank connection prior to the switching control valve 42 being moved to the second position.

It is to be appreciated and will be apparent to those skilled in the art that many physical changes, only a few of which are exemplified in the detailed description, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A switching oil gallery de-aeration arrangement for a switchable valve arrangement, comprising:

a cylinder head including a bore, a hydraulic lash adjuster fluid gallery that intersects the bore at a first intersection, and a switching hydraulic fluid gallery that intersects the bore at a second intersection offset from the first intersection;

a hydraulic lash adjuster assembly comprising:

a housing positioned in the bore of the cylinder head including a first hydraulic lash adjuster fluid port on a radially outer wall of the housing at the first intersection, a second switching hydraulic fluid port on the radially outer wall of the housing at the second intersection, a passage formed on the radially outer wall between the first fluid port and the second fluid port, and a throttle to reduce pressure located in the passage between the hydraulic lash adjuster fluid gallery and the switching hydraulic fluid gallery, wherein the throttle is a protruded section of the radially outer wall of the housing relative to the passage;

a plunger arranged within the housing that is axially displaceable therein; and a switching control valve connected to a pressurized fluid source, the switching control valve being adapted to activate or deactivate the switchable valve arrangement, the switching control valve is movable from a first position, in which pressurized hydraulic fluid from the hydraulic lash adjuster fluid gallery flows to the first intersection, through the passage and through the switching hydraulic fluid gallery to a check valve such that pressurized hydraulic fluid from the hydraulic lash adjuster fluid gallery pressurizes the switching hydraulic fluid gallery and is released through the check valve, and a second position, in which pressurized hydraulic fluid having a higher pressure sufficient for carrying out a switching function of the switchable valve arrangement is delivered by the switching hydraulic fluid gallery via the second intersection to the second port.

2. The switching oil gallery de-aeration arrangement of claim 1, wherein the passage is formed by a single flat surface on the radially outer wall of the housing.

3. The switching oil gallery de-aeration arrangement of claim 1, wherein the first and second ports are located in separate annular grooves on the radially outer wall of the housing.

4. The switching oil gallery de-aeration arrangement of claim 1, wherein the throttle is adjacent to the second port.

5. The switching oil gallery de-aeration arrangement of claim 1, wherein the hydraulic lash adjuster assembly is switchable between two lift modes.

6. The switching oil gallery de-aeration arrangement of claim 1, further comprising a switchable roller finger follower with a hydraulically actuated locking mechanism that is switchable between two lift modes.

7. The switching oil gallery de-aeration arrangement of claim 1, wherein in the first position the check valve is located between the switching hydraulic fluid gallery and a tank connection.

8. The switching oil gallery de-aeration arrangement of claim 7, wherein the check valve is set to release at a pressure of 0.1 bar or greater.

9. The switching oil gallery de-aeration arrangement of claim 1, wherein the hydraulic lash adjuster fluid gallery is also connected to standard hydraulic lash adjusters.

10. A method of de-aerating a switching hydraulic fluid gallery for a switchable valve arrangement of an internal combustion engine, the method comprising:

providing a switching oil gallery de-aeration arrangement having a cylinder head including a bore, a hydraulic lash adjuster fluid gallery that intersects the bore at a first intersection, and a switching hydraulic fluid gallery that intersects the bore at a second intersection axially offset from the first intersection; a hydraulic lash adjuster assembly including a housing positioned in the bore of the cylinder head including an annular body that includes a first hydraulic lash adjuster fluid port on a radially outer wall of the housing at the first intersection, a second switching hydraulic fluid port on the radially outer wall of the housing at the second intersection, a passage formed on the radially outer wall between the first fluid port and the second fluid port, and a throttle to reduce pressure located in the passage between the hydraulic lash adjuster fluid gallery and the switching hydraulic fluid gallery, wherein the throttle is a protruded section of the radially outer wall of the housing relative to the passage, and a plunger arranged within the housing that is axially displaceable therein; and a switching control valve connected to a pressurized fluid source, the switching control valve being adapted to activate or deactivate a switchable valve arrangement, the switching control valve is movable from a first position, in which pressurized hydraulic fluid from the hydraulic lash adjuster fluid gallery flows to the first intersection, through the passage and through the switching hydraulic fluid gallery to a check valve so that pressurized hydraulic fluid from the hydraulic lash adjuster fluid gallery pressurizes the switching hydraulic fluid gallery, and a second position, in which pressurized hydraulic fluid having a higher pressure sufficient for carrying out a switching function of the switchable valve arrangement is delivered by the switching hydraulic fluid gallery to the second port; and feeding pressurized hydraulic fluid from the hydraulic lash adjuster fluid gallery to the first intersection, through the passage and through the switching hydraulic fluid gallery to the check valve so that pressurized hydraulic fluid from the hydraulic lash adjuster fluid gallery pressurizes the switching hydraulic fluid gallery in the first position so that air bubbles in the hydraulic fluid in the switching hydraulic fluid gallery are carried to a tank connection prior to the switching control valve being moved to the second position.

* * * * *